US005755138A

United States Patent [19]

Mototani et al.

[11] Patent Number: 5,755,138

[45] Date of Patent: May 26, 1998

[54] ELECTRICAL LEVER ASSEMBLY

[75] Inventors: Masayoshi Mototani; Seita Hayashi, both of Oyama, Japan

[73] Assignee: Komatsu Ltd., Tokyo, Japan

[21] Appl. No.: 652,487

[22] PCT Filed: Dec. 6, 1994

[86] PCT No.: PCT/JP94/02051

§ 371 Date: May 22, 1996

§ 102(e) Date: May 22, 1996

[87] PCT Pub. No.: WO95/16232

PCT Pub. Date: Jun. 15, 1995

[30] Foreign Application Priority Data

Dec. 7, 1993 [JP] Japan ..... 5-306402

[51] Int. Cl.[6] ..... G05G 1/04; H01C 10/20

[52] U.S. Cl. ..... 74/471 R; 74/469; 338/68

[58] Field of Search ..... 74/471 R, 469; 338/68

[56] References Cited

U.S. PATENT DOCUMENTS

| | | | |
|---|---|---|---|
| 2,438,410 | 3/1948 | May | 74/471 R |
| 2,466,080 | 4/1949 | Cook et al. | 74/471 R |
| 3,131,573 | 5/1964 | Bent | 74/471 R |
| 3,260,826 | 7/1966 | Johnson | 74/471 R |
| 3,308,675 | 3/1967 | Jonsson | 74/471 R |
| 3,504,566 | 4/1970 | Zurcher | 74/471 R |
| 3,792,408 | 2/1974 | Gorgens et al. | 338/68 |
| 4,069,720 | 1/1978 | Thor . | |
| 4,526,204 | 7/1985 | Primdahl | 74/471 R |
| 5,301,568 | 4/1994 | Kono | 74/525 |

FOREIGN PATENT DOCUMENTS

| | | |
|---|---|---|
| 62-140636 | 9/1987 | Japan . |
| 64-21423 | 2/1989 | Japan . |
| 5-4016 | 2/1993 | Japan . |

*Primary Examiner*—Charles A. Marmor
*Assistant Examiner*—David M. Fenstermacher
*Attorney, Agent, or Firm*—Frishauf, Holtz, Goodman, Langer & Chick

[57] ABSTRACT

An electrical lever assembly includes a lever rockably supported on a main body, a rod vertically sliding with a disc provided on the lever, a potentiometer having a horizontally rotating shaft mounted on the lower surface of the main body, and an arm connecting the potentiometer and the rod. The potentiometer is mounted on the lower surface of the main body in a condition adjustable with respect to a position in a vertical direction and a horizontal direction.

20 Claims, 8 Drawing Sheets

$$\left|\frac{V_2-V_0}{V_1-V_0}\right| > 1+\alpha$$

OR $$\left|\frac{V_2-V_0}{V_1-V_0}\right| < 1-\alpha$$

$|V_2 - V_1| > \beta$ OR $|V_2 - V_1| > \gamma$

ELECTRICAL LEVER ASSEMBLY

TECHNICAL FIELD

The present invention relates to an electrical lever assembly for outputting an electrical signal proportional to a rocking angle by a rocking motion of a lever.

BACKGROUND ART

As an electrical lever assembly, one disclosed in Japanese Unexamined Utility Model Publication (Kokai) No. Showa 62-140636 has been known. The electrical lever assembly disclosed therein is designed to support a lever in a housing for rocking motion in back and forth and left and right directions for causing a rocking motion of first and second gimbals so that a pair of front and back sides potentiometers are rotated by the rocking motion of the first gimbal for outputting an electrical signal, and so that a pair of left and right side potentiometers are rotated by the rocking motion of the second gimbal for outputting an electrical signal.

In such electrical lever assembly, an error in the output voltages of the potentiometers in relation to the rocking angle of the lever may be caused by error in machining and error in mounting.

For example, an error between the output voltage generated when the lever is rocked in one direction over a given angle and the output voltage generated when the lever is rocked in another direction over the same angle may be greater than or equal to a standardized value, or the error of the output voltage in relation to a unit rocking angle of the lever may be out of the standardized value.

When such error is caused in the output voltage of the potentiometer, it becomes very difficult to accurately control an electromagnetic valve corresponding to the rocking operation of the lever upon switching the position of the electromagnetic valve by outputting a control signal to the electromagnetic valve with inputting the output voltage of the potentiometer to a controller.

Therefore, in the prior art, an external resistor for adjusting the output voltage of the potentiometer is provided for adjustment, or in the alternative, an internal adjustment is made internally in the controller for adjusting the output voltage of the potentiometer.

However, when the external resistor is employed, assembling and adjusting operation becomes cumbersome. On the other hand, when the internal adjustment is made in the controller, compatibility of the lever assembly and the controller becomes poor to thereby cause a problem in term of the supply of parts.

The present invention has been worked out for solving the problems set forth above, and is thus intended to provide an electrical lever assembly which facilitates assembling and adjusting operations and to provide greater compatibility between the electrical lever assembly and a controller to thereby simplify the supply of parts.

DISCLOSURE OF THE INVENTION

In order to accomplish the above-mentioned object, an electrical lever assembly, according to the present invention, comprises a lever rockably supported on a main body;

a rod vertically sliding with a disc provided on the lever;

a potentiometer having a horizontally rotating shaft mounted on the lower surface of the main body; and an arm connecting the potentiometer and the rod, the potentiometer being mounted on the lower surface of the main body in a condition adjustable with respect to a position in a vertical direction and a horizontal direction.

With the construction set forth above, by moving the potentiometer relative to the main body of the assembly in vertical and horizontal directions, the positional relationship of the rotary shaft of the potentiometer and the rod moving vertically by rocking motion of the lever can be easily adjusted, whereby an error of the output voltage of the potentiometer can be corrected, and thus assembling and adjusting operations can be facilitated, and compatibility of the electrical lever assembly can be improved so as to simplify the supply of parts.

In the construction set forth above, it is preferred that the potentiometer is mounted on a bracket in a condition adjustable with respect to height, and that the bracket is mounted on the lower surface of the main body in a condition adjustable with respect to a position in the horizontal direction perpendicular to a rotary shaft of the potentiometer.

On the other hand it is possible to interpose a shim between the bracket and the lower surface of the main body.

Also, it is preferred that the bracket comprises a mounting plate and a mounting piece integral with the mounting plate, that the potentiometer is mounted on the mounting piece, that the mounting plate is formed with an elongated hole extending in a direction perpendicular to the rotary shaft of the potentiometer, that the mounting plate is temporarily mounted by engaging a screw to the lower surface of the main body through the elongated hole, and that the mounting plate is subsequently fixed by means of a bolt after adjustment of the position of the mounting plate in the horizontal direction.

It is also preferred that a mounting recess is formed on the mounting piece of the bracket, and that the potentiometer is mounted on the mounting piece by engaging an end portion of the potentiometer into the mounting recess and threadingly engaging a bolt to the end portion.

Also, in addition to the construction set forth above, an elongated circular hole may be formed in the mounting plate of the bracket, and a tip end of an assembling jig having an eccentric portion may be engaged with a hole on the lower surface of the main body via the elongated circular hole to engage an eccentric portion to the elongated circular hole for performing position adjustment in the horizontal direction by shifting the bracket by rotation of the assembling jig with the elongated hole and screw as a guide.

Furthermore, it is possible that an elongated groove having a pair of mutually opposing arc-shaped recesses is formed at the tip end of the arm, and that a spherical portion of the rod is engaged with a pair of mutually opposing arc-shaped recessed portions for connecting the arm and the rod.

It is further possible that a small diameter portion of the rod is inserted into the elongated groove of the arm and that a tapered portion of the rod is urged toward an upper edge of the elongated groove by providing a spring between the flange portion at the tip end of the rod and the tip end portion of the arm for connecting the lever and the rod.

It is further possible that a block is mounted on the lower surface of the main body, that the bracket is mounted on the block that the potentiometer is mounted on the lower surface of the block in a movable fashion in the horizontal direction perpendicular to a rotary shaft of the potentiometer, wherein a rod is inserted into a large diameter hole of the block and is connected to the lever, a spring seat and a ball retainer are provided within the large diameter hole, and a spring is disposed between the spring seat and the ball retainer for urging ball onto the outer periphery of the rod with the ball retainer, and a downward step is formed on the rod so that the ball is urged below by the step when the rod is shifted upwardly from the neutral position.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

The preferred embodiment of an electrical lever assembly according to the present invention will be discussed hereinafter with reference to the accompanying drawings.

Figure 1:
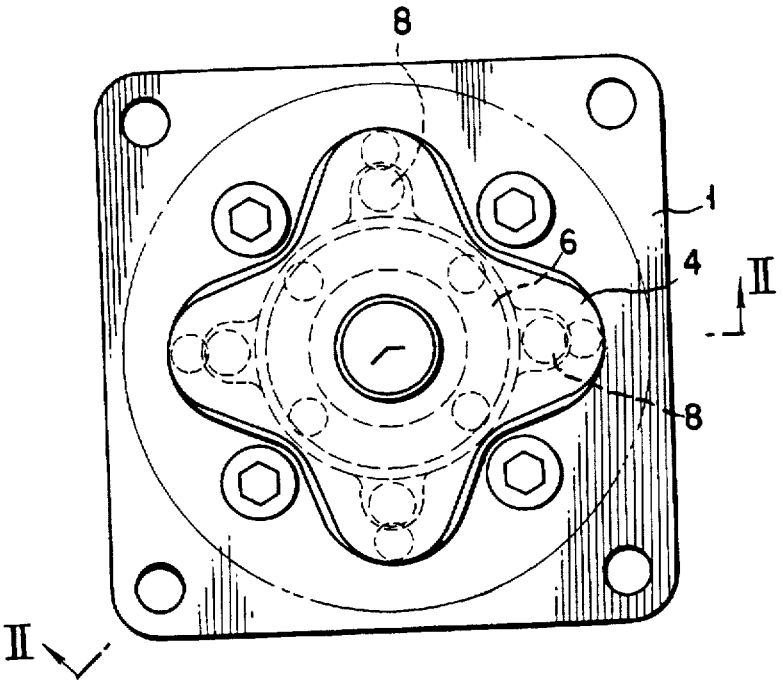
FIG. 1 is a plan view showing one embodiment of an electrical lever assembly according to the present invention.
Figure 2:
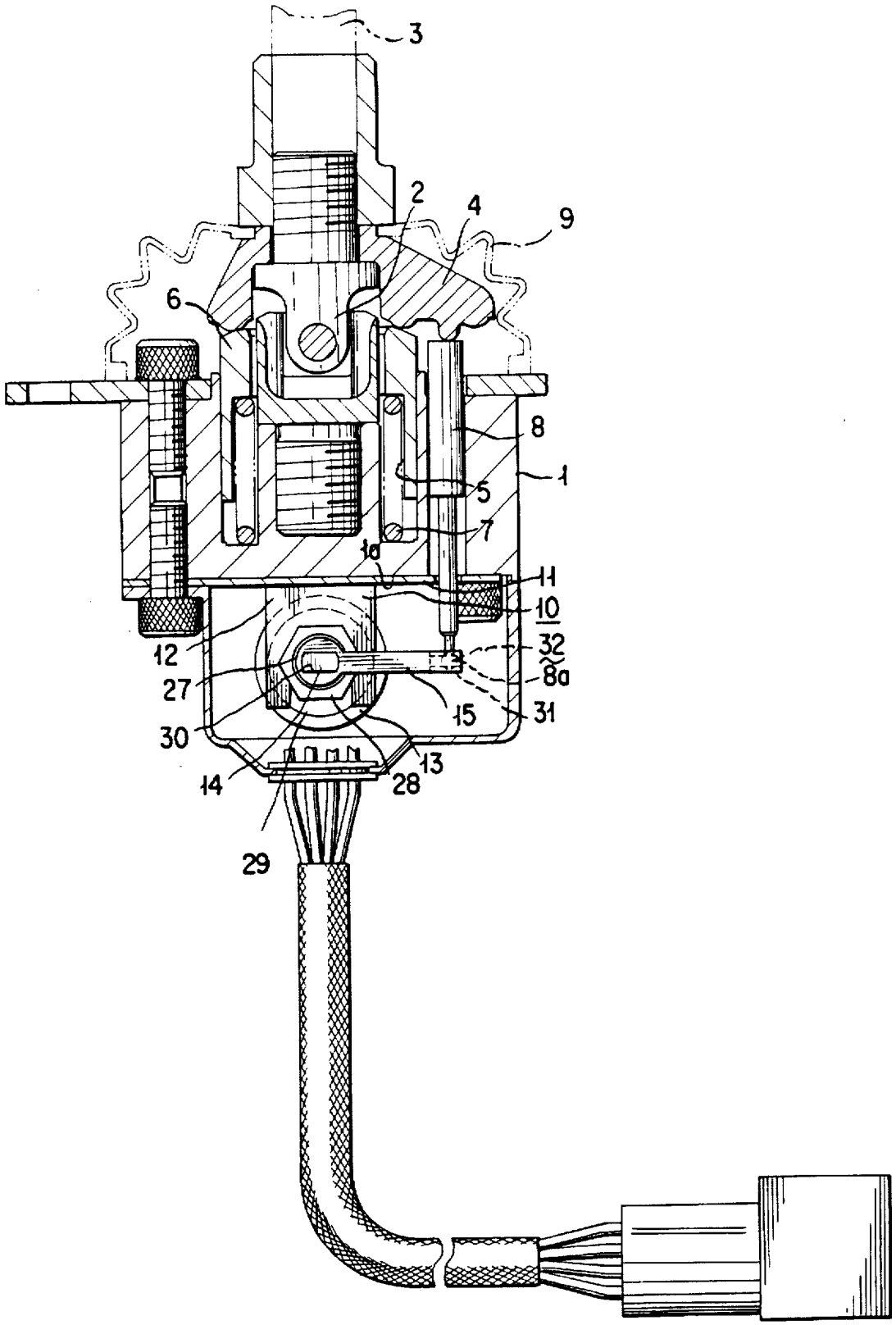
FIG. 2 is a section taken along line II—II of FIG. 1.

As shown in FIGS. 1 and 2, a lever 3 is mounted on a main body 1 via a universal joint 2 for rocking in an arbitrary direction. A disc 4 is mounted on the lever 3. An annular recessed groove 5 is formed around the universal joint 2 of the main body 1. A cylindrical body 6 is fitted into the annular recessed groove 5. The cylindrical body 6 is pushed upwardly to abut onto the disc 4 by a spring 7 for maintaining the lever 3 at the neutral position. A plurality of rods 8 are supported on the main body 1 for sliding movement in vertical direction to contact the upper portions thereof to the disc 4 for vertical sliding movement thereof by rocking motion of the lever 3. 9 denotes a cover formed of an elastic material mounted over the main body 1 and the lever 3.

Figure 3:
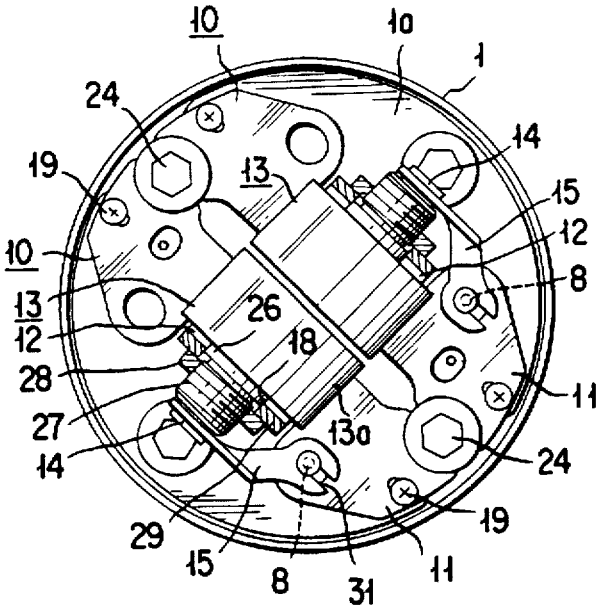
FIG. 3 is a bottom view of a main body of the foregoing embodiment.

On the lower surface 1*a* of the main body 1, a pair of brackets 10 are mounted, as shown in FIGS. 2 and 3. The bracket 10 is constructed by integrally providing mounting pieces 12 on a mounting plate 11. On each mounting piece 12, a potentiometer 13 having a rotary shaft 14 in horizontal direction is mounted. An arm 15 mounted on each of the rotary shafts 14 and the lower portion of the rods 8 are connected.

Figure 4:
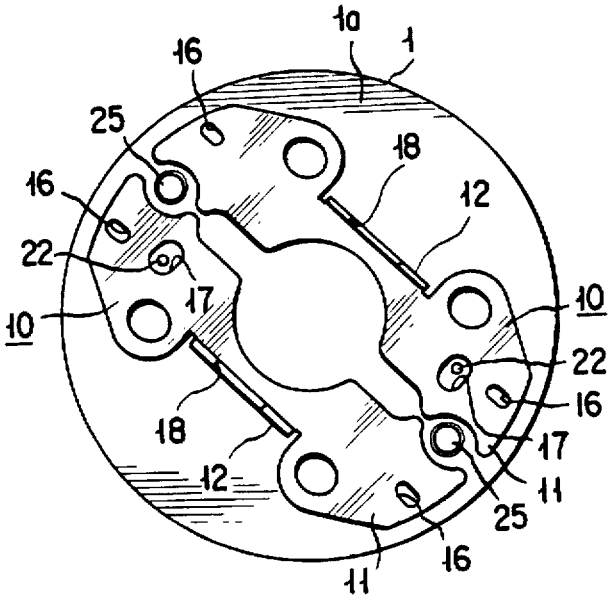
FIG. 4 is a bottom view of a bracket mounting portion of the foregoing embodiment.
Figure 5:
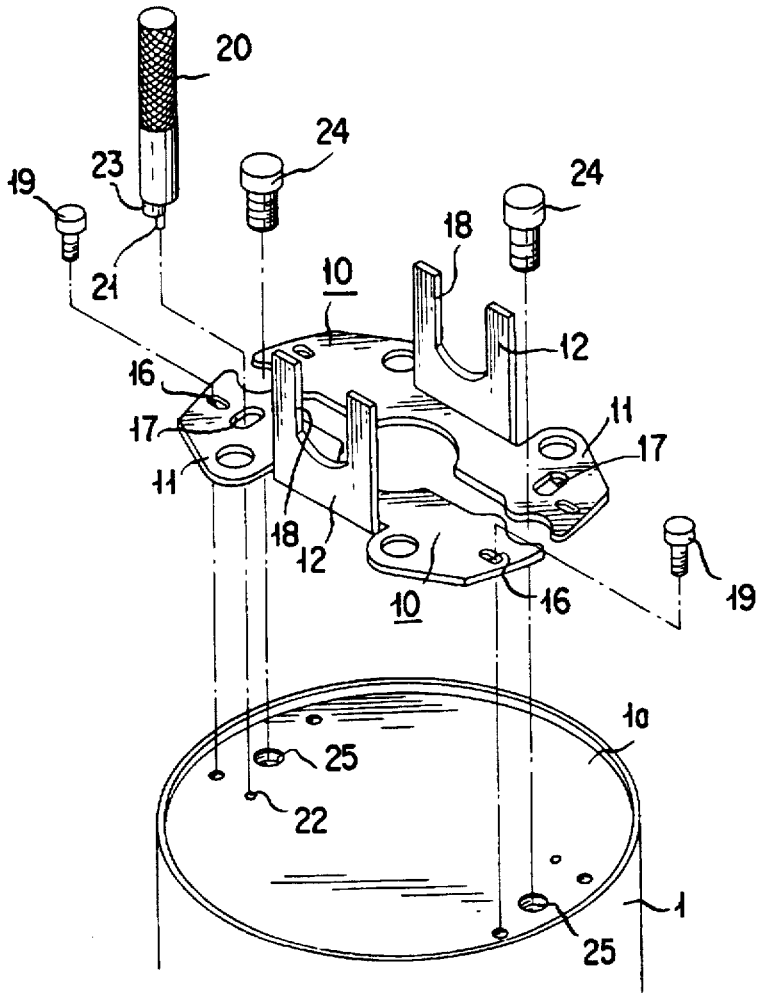
FIG. 5 is an exploded perspective view of the bracket of the foregoing embodiment.
Figure 6:
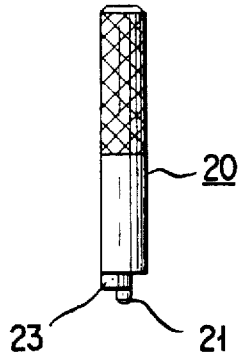
FIG. 6 is a front elevation showing an assembling jig to be used for position adjustment of the bracket.

On the mounting plates 11 of the bracket 10, a pair of elongated holes 16 extending in parallel to the mounting piece 12 are formed in opposition to each other at both sides of the mounting piece 12. Also, an elongated circular hole 17 is formed as shown in FIGS. 4 and 5. On the other hand, on each of the mounting pieces 12, a mounting recess 18 is formed. Here, by temporarily mounting the bracket 10 by threadingly engage screws 19 to the lower surface 1*a* of the main body 1 through a pair of elongated holes 16, and inserting a projection 21 of an assembling jig 20 shown in FIG. 6 into an opening 22 formed on the lower surface 1*a* of the main body 1 through the elongated circular hole 17 to fit an eccentric portion 23 of the assembling jig 20 into the elongated circular hole 17, an adjustment of position is performed by shifting the bracket 10 in the horizontal direction with taking a pair of screws 19 and the elongated holes 16 as guide. Subsequently, bolts 24 are threadingly engaged with bolt holes 25 formed in the lower surface 1*a* of the main body 1 to fix the pair of brackets 10 onto the lower surface la of the main body 1. By this, the mounting position of the potentiometer 13 can be adjusted in the horizontal direction (a direction perpendicular to the rotary shaft 14).

The main body 13*a* of the potentiometer 13 has a mounting portion 26 and a threaded portion 27. The potentiometer 13 is mounted on the bracket 10 by engaging the mounting portion 26 with the mounting recess 18 of the mounting piece 12 and urging a holding washer 29 onto the mounting piece 12 by threadingly engage a nut 28 with threaded portion 27. On the other hand, the mounting height of the potentiometer 13 can be adjusted by loosening the nut 28 and by moving the mounting portion 26 along the mounting recess 18 of the mounting piece 12.

A rectangular hole 30 is formed at one end of the arm 15, and a pair of upper and lower elongated grooves 31 are formed at the other end. On the opposing inner surfaces of these elongated grooves 31, arc-shaped recessed portions 32 are formed. The rectangular hole 30 engages with a rectangular stem portion of the rotary shaft 14 and the elongated grooves 31 are engaged with the shaft portion at the lower end of the rod 8. Also, a ball-shaped portion 8*a* is engaged between the pair of arc shaped recess portions 32.

With the construction set forth above, the connecting portion of the rod 8 and the arm 15 is permitted relative displacement in the vertical and longitudinal direction without looseness. Thus, the rotary shaft 14 is accurately rotated by vertical movement of the rod 8 so that the potentiometer 13 may accurately output the electrical signal proportional to the rocking angle of the lever 13.

Figure 7:
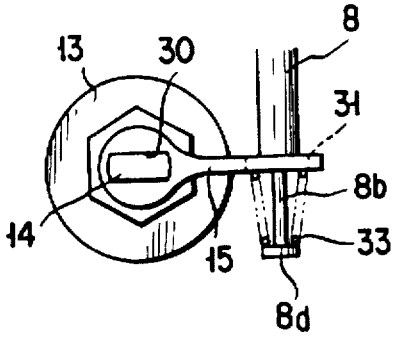
FIG. 7 is a front elevation showing another embodiment of a connecting portion between a lever and a rod.
Figure 8:
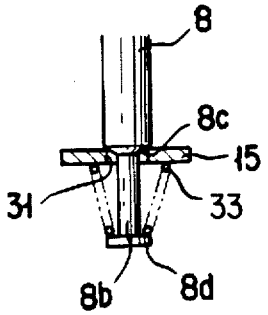
FIG. 8 is a section of the connecting portion shown in FIG. 7.

It should be noted that the arm 15 and the rod 8 may be connected as shown in FIGS. 7 and 8.

Namely, on the lower end of the rod 8 a small diameter portion 8*b* and a flange portion 8*d* are formed. The smaller diameter portion 8*b* is inserted through the elongated groove 31 of the arm 15. A tapered surface portion 8*c* is urged toward the upper edge portion of the elongated groove 31 by means of a spring 33 disposed between the other end of the arm 15 and the flange portion 8*d*.

By this, the arm 15 can be connected with the rod 8 without looseness.

Next, discussion will be given for adjustment of the mounting position of the potentiometer 13.

As shown in FIGS. 9–12, $V_0$ is a standard reference voltage having a standard width defining a standardized value range, and $V_1$ and $V_2$ are voltages outside the standardized value range.

Figure 9:
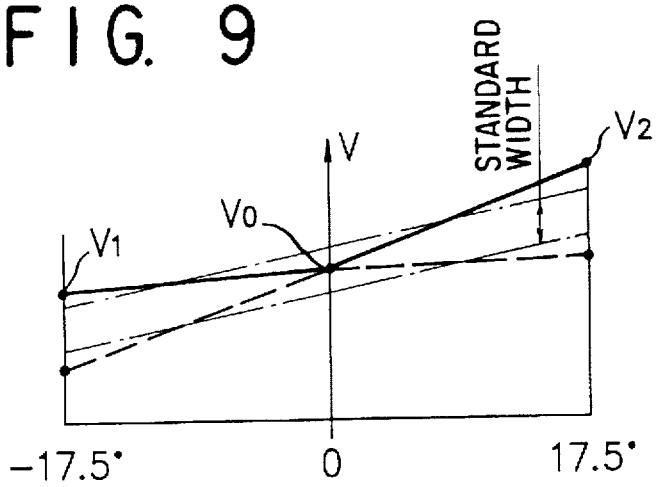
FIG. 9 is a graph showing a relationship between a output voltage of a potentiometer and a rocking angle of the lever.
Figure 10:
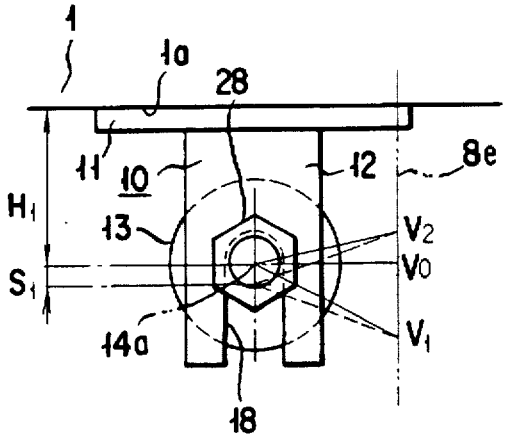
FIG. 10 is an explanatory illustration showing adjusting operation of the output voltage of the potentiometer to be performed in the case of FIG. 9.

When the output voltage is outside of the standardized value range even by adjustment as shown in FIG. 9 after mounting the potentiometer 13 as set forth above, namely, in the case where the center 14*a* of the rotary shaft of the potentiometer 13 is inclined toward the lower surface 1*a* of the main body 1 (mounting height of the potentiometer is $H_1$), the nut 28 is loosened and the potentiometer is shifted downwardly along the mounting recess 18 of the mounting piece 12, as set forth above, in the magnitude of $S_1$ as shown in FIG. 10. It should be noted that 8*e* is a center of the rod.

It should be noted that adjustment can be made by inserting a shim between the mounting plate 11 and the lower surface 1*a* of the main body 1.

Figure 11:
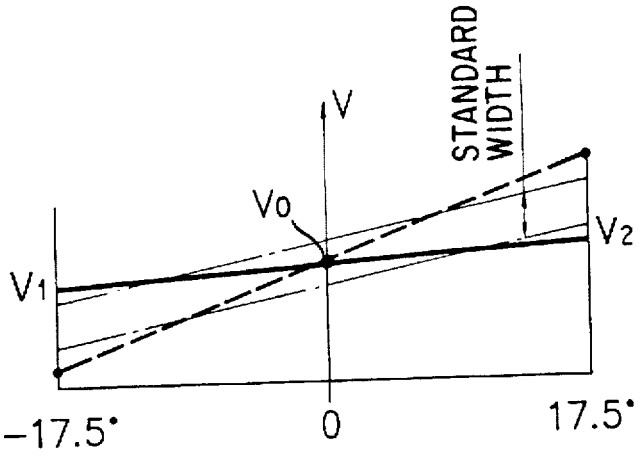
FIG. 11 is a graph showing another relationship between a output voltage of a potentiometer and a rocking angle of the lever.
Figure 12:
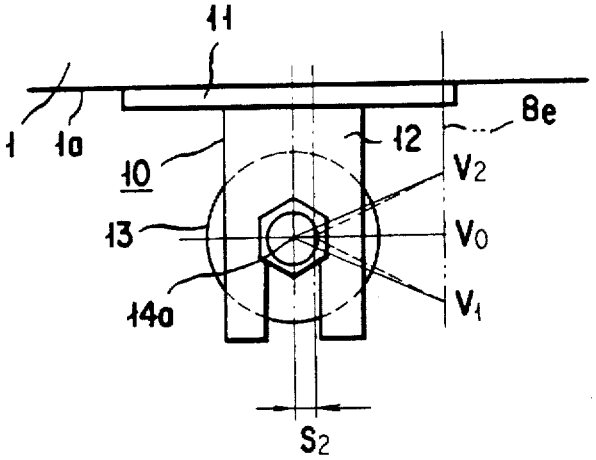
FIG. 12 is an explanatory illustration showing adjusting operation of the output voltage of the potentiometer to be performed in the case of FIG. 11.

On the other hand, in the case where output voltage is outside of the standardized value range as shown in FIG. 11, namely, when a distance between the center 8*e* of the rod and the center 14*a* of the rotary shaft is long as shown in FIG. 12, the bracket 10 is shifted in the horizontal direction in the magnitude of $S_2$.

In the electrical lever assembly as set forth above, when a hand is released from the lever 3, it is returned to the neutral position. Therefore, it is cumbersome to maintain operation of the lever 3 when outputting of the electrical signal is maintained. Therefore, next, discussion will be given for another embodiment of the electrical lever assembly with a detent which can maintain the operated position of the lever 3.

Figure 13:
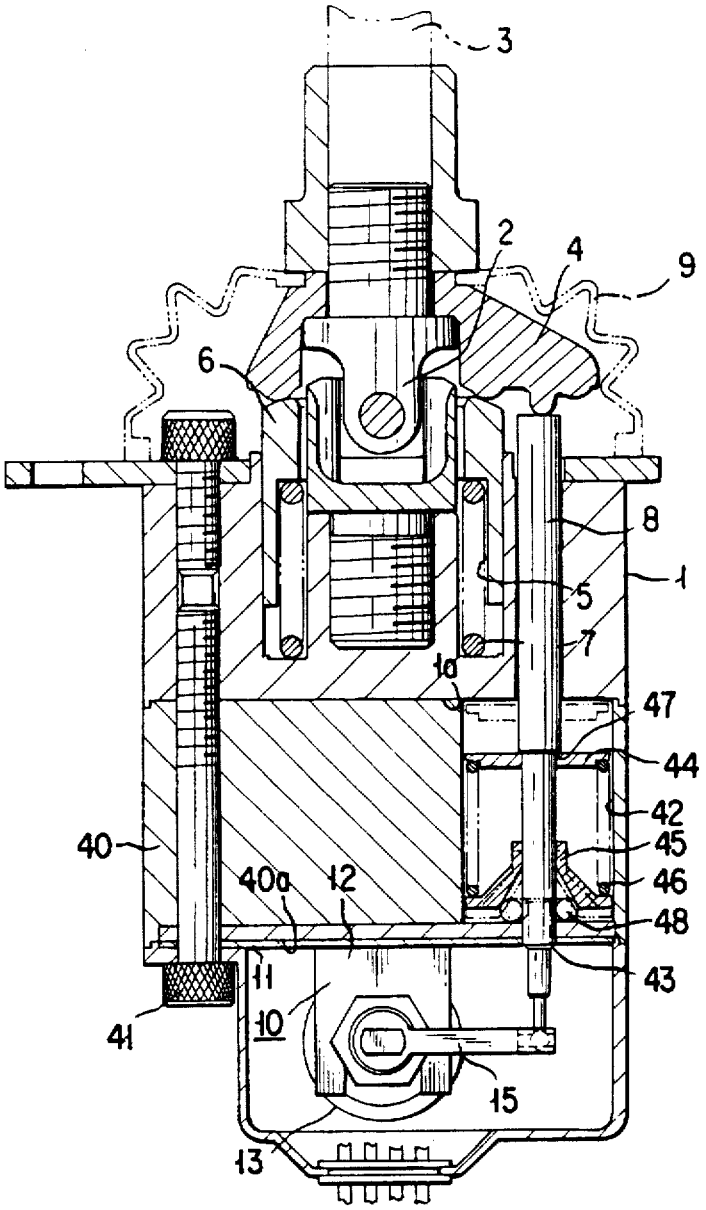
FIG. 13 is a section showing another embodiment, in which a detent is provided.

As shown in FIG. 13, a block 40 is mounted on the lower surface 1*a* of the main body 1 by means of a bolt 41. The bracket 10 is mounted on the lower surface 40*a* of the block 40 to mount the potentiometer 13 to the bracket 10, as set forth above.

The block 40 is formed with large diameter hole 42 opening in upper and lower surfaces. A rod 8 is inserted through the large diameter hole 42 be connected with the arm 15 similarly to that set forth above. A downward step 43 is formed on the rod 8 at the portion by the side of the lower portion.

In the large diameter portion 42, a spring seat 44 and a ball retainer 45 are provided. A spring 46 is disposed between the spring seat 44 and the ball retainer 45 to urge the spring seat 44 onto a stepped portion 47 of the rod 8. Also, balls 48 are urged onto the outer periphery of the rod 8 by means of the ball retainer 45.

With such construction, when the rod 8 is shifted upwardly by the rocking motion of the lever 3, the spring seat 44 is shifted upwardly and the ball 48 is urged to the downwardly stepped portion 43 of the rod 8 so as to prevent the rod 8 from shifting downwardly, as shown by phantom line in FIG. 13. Accordingly, even when the hand is released from the lever 3, the rod 8 is positioned as illustrated by the phantom line. Then, the arm 15 becomes upwardly oriented attitude as shown by the phantom line. Thus, the potentiometer 13 maintains outputting of the electrical signal.

From this condition, by pushing the rod 8 downwardly by operating the lever 3, the ball 48 is shifted outwardly. As a result, the rod 8 can be shifted downwardly.

Although the invention has been illustrated and described with respect to an exemplary embodiment thereof, it should be understood by those skilled in the art that various changes, omissions and additions may be made therein and thereto, without departing from the spirit and scope of the present invention. Therefore, the present invention should not be understood as being limited to the specific embodiment set out above. The present invention includes all possible embodiments which can be embodied within a scope encompassed by the features set out in the appended claims and equivalents thereof.

The invention claimed is:

1. An electrical lever assembly comprising:

a lever rockably supported on a main body;

a rod supported on the main body so as to be slidable in a vertical direction;

a disc provided on said lever for contacting the rod to cause the rod to slide in the vertical direction responsive to a rocking motion of the lever;

a potentiometer mounted on a lower surface of said main body, said potentiometer having a rotary shaft rotatable in a horizontal direction;

an arm connecting said potentiometer and said rod;

a first support for supporting said potentiometer so as to permit adjustment of a position of said potentiometer in the vertical direction; and a second support for supporting said potentiometer so as to permit adjustment of the position of said potentiometer in the horizontal direction.

2. An electrical lever assembly as set forth in claim 1, wherein said first support comprises a bracket mounting said potentiometer on the lower surface of said main body.

3. An electrical lever assembly as set forth in claim 2, further comprising a shim interposed between said bracket and the lower surface of said main body.

4. An electrical level assembly as set forth in claim 3, wherein:

an elongated groove having a pair of mutually opposing arc-shaped recesses is formed at a tip end of the arm; and a spherical portion of the rod is engaged with the pair of mutually opposing arc-shaped recesses for connecting the arm and the rod.

5. An electrical lever assembly as set forth in claim 3, wherein:

a small diameter portion of the rod is inserted into an elongated groove in the arm; and a tapered portion of the rod is urged toward an upper edge of the elongated groove by a spring provided between a flange portion at a tip end of the rod and a tip end portion of the arm for connecting the lever and the rod.

6. An electrical lever assembly as set forth in claim 2, wherein:

a small diameter portion of the rod is inserted into an elongated groove in the arm; and a tapered portion of the rod is urged toward an upper edge of the elongated groove by a spring provided between a flange portion at a tip end of the rod and a tip end portion of the arm for connecting the lever and the rod.

7. An electrical level assembly as set forth in claim 2, wherein:

an elongated groove having a pair of mutually opposing arc-shaped recesses is formed at a tip end of the arm; and a spherical portion of the rod is engaged with the pair of mutually opposing arc-shaped recesses for connecting the arm and the rod.

8. An electrical lever assembly as set forth in claim 2, wherein:

said second support comprises a mounting plate and a mounting piece integral with said mounting plate;

said potentiometer is mounted on said mounting piece;

said mounting plate is formed with an elongated hole extending in a direction perpendicular to the rotary shaft of said potentiometer;

said mounting plate is temporarily mounted by engaging a screw to the lower surface of said main body, and is subsequently fixed by a bolt after adjustment of a position of the mounting plate in the horizontal direction.

9. An electrical lever assembly as set forth in claim 8, wherein a tip end of an assembling jig having an eccentric portion is engaged with a hole on the lower surface of the main body via said elongated hole formed in the mounting plate of said second support to thereby engage the eccentric portion with said elongated hole for performing position adjustment in the horizontal direction by shifting said second support by rotation of said assembling jig with said elongated hole and screw as a guide.

10. An electrical level assembly as set forth in claim 9, wherein:

an elongated groove having a pair of mutually opposing arc-shaped recesses is formed at a tip end of the arm; and a spherical portion of the rod is engaged with the pair of mutually opposing arc-shaped recesses for connecting the arm and the rod.

11. An electrical lever assembly as set forth in claim 9, wherein:

a small diameter portion of the rod is inserted into an elongated groove in the arm; and a tapered portion of the rod is urged toward an upper edge of the elongated groove by a spring provided between a flange portion at a tip end of the rod and a tip end portion of the arm for connecting the lever and the rod.

12. An electrical level assembly as set forth in claim 8, wherein:

an elongated groove having a pair of mutually opposing arc-shaped recesses is formed at a tip end of the arm; and a spherical portion of the rod is engaged with the pair of mutually opposing arc-shaped recesses for connecting the arm and the rod.

13. An electrical lever assembly as set forth in claim 8, wherein:

a small diameter portion of the rod is inserted into an elongated groove in the arm; and a tapered portion of the rod is urged toward an upper edge of the elongated groove by a spring provided between a flange portion at a tip end of the rod and a tip end portion of the arm for connecting the lever and the rod.

14. An electrical lever assembly as set forth in claim 8, wherein:

a mounting recess is formed on said mounting piece of said second support; and said potentiometer is mounted on said mounting piece by engaging an end portion of said potentiometer with said mounting recess and threadingly engaging a bolt to said end portion.

15. An electrical level assembly as set forth in claim 14, wherein:

an elongated groove having a pair of mutually opposing arc-shaped recesses is formed at a tip end of the arm; and a spherical portion of the rod is engaged with the pair of mutually opposing arc-shaped recesses for connecting the arm and the rod.

16. An electrical lever assembly as set forth in claim 14, wherein a tip end of an assembling jig having an eccentric portion is engaged with a hole on the lower surface of the main body via said elongated hole formed in the mounting plate of said second support to thereby engage the eccentric portion with said elongated hole for performing position adjustment in the horizontal direction by shifting said second support by rotation of said assembling jig with said elongated hole and screw as a guide.

17. An electrical lever assembly as set forth in claim 14, wherein:

a small diameter portion of the rod is inserted into an elongated groove in the arm; and a tapered portion of the rod is urged toward an upper edge of the elongated groove by a spring provided between a flange portion at a tip end of the rod and a tip end portion of the arm for connecting the lever and the rod.

18. An electrical level assembly as set forth in claim 1, wherein:

an elongated groove having a pair of mutually opposing arc-shaped recesses is formed at a tip end of the arm; and a spherical portion of the rod is engaged with the pair of mutually opposing arc-shaped recesses for connecting the arm and the rod.

19. An electrical lever assembly as set forth in claim 1, wherein:

a small diameter portion of the rod is inserted into an elongated groove in the arm; and a tapered portion of the rod is urged toward an upper edge of the elongated groove by a spring provided between a flange portion at a tip end of the rod and a tip end portion of the arm for connecting the lever and the rod.

20. An electrical lever assembly comprising:

a lever rockably supported on a main body;

a rod supported on the main body so as to be slidable in a vertical direction;

a disc provided on said lever for contacting the rod to cause the rod to slide in the vertical direction responsive to a rocking motion of the lever;

a potentiometer having a rotary shaft rotatable in a horizontal direction;

a block mounted on a lower surface of the main body, said potentiometer being mounted on a lower surface of the block by a bracket so as to permit adjustment of a position of the potentiometer in the horizontal and vertical directions; and an arm connecting said potentiometer and said rod;

wherein the rod is inserted into a large diameter hole of the block and is connected to the lever;

wherein a spring seat and a ball retainer are provided within said large diameter hole, and a spring is disposed between the spring seat and the ball retainer for urging a ball onto an outer periphery of the rod with the ball retainer; and wherein a downward step is formed on the rod so that the ball is urged below the step when the rod is shifted upwardly from a neutral position.

* * * * *